US006763689B1

(12) United States Patent
Thomas

(10) Patent No.: US 6,763,689 B1
(45) Date of Patent: Jul. 20, 2004

(54) SURFBOARD LOCK SYSTEM

(76) Inventor: Jerry L. Thomas, 17649 SE. Federal Hwy., Tequesta, FL (US) 33469

( * ) Notice: Subject to any disclaimer, the term of this patent is extended or adjusted under 35 U.S.C. 154(b) by 0 days.

(21) Appl. No.: 10/722,764

(22) Filed: Nov. 28, 2003

(51) Int. Cl.[7] ..... E05B 73/00
(52) U.S. Cl. ..... 70/14; 70/18; 70/58; 441/74
(58) Field of Search ..... 70/14, 18, 58, 70/232; 411/74; 211/4; 224/323, 324; 280/814; 441/74

(56) References Cited

U.S. PATENT DOCUMENTS 3,091,011 A * 5/1963 Campbell ..... 280/814
3,564,632 A * 2/1971 Bahne ..... 441/79
3,727,934 A * 4/1973 Averbook et al. ..... 280/814
4,340,376 A * 7/1982 Williams ..... 441/74
4,680,949 A * 7/1987 Stewart ..... 70/14
4,712,394 A * 12/1987 Bull ..... 70/18
4,883,436 A * 11/1989 Oakland ..... 441/65
4,896,519 A * 1/1990 Pitts ..... 70/50
4,938,040 A * 7/1990 Humphreys, Jr. ..... 70/58
5,109,683 A * 5/1992 Cartwright ..... 70/14
5,119,649 A 6/1992 Spence
5,127,861 A 7/1992 Ross
5,467,617 A * 11/1995 Huebner ..... 70/18
5,582,044 A 12/1996 Bolich
5,706,680 A 1/1998 Wroble
6,003,348 A 12/1999 McCrea
6,082,154 A * 7/2000 MacDonald ..... 70/18
6,135,836 A * 10/2000 Rhynsburger ..... 441/74
6,688,145 B2 * 2/2004 Tan ..... 70/58
6,691,537 B2 * 2/2004 Tan ..... 70/58

* cited by examiner

*Primary Examiner*—Suzanne Dino Barrett
(74) *Attorney, Agent, or Firm*—Alvin S. Blum

(57) ABSTRACT

A locking assembly for a surfboard enables the board to be tethered to a non-portable object with a lockable cable. The cable passes through a transverse hole in one of the fins. To prevent the fin from being removed from the by a thief, a rigid sleeve is provided that slides over the fin. It is provided with a transverse hole in registry with the hole in the fin, so that the cable will pass through the sleeve and the fin. This renders the two inseparable. A flange affixed to the base of the sleeve covers the fasteners that fasten the fin to the board. This prevents the thief from removing the fin from the board.

2 Claims, 2 Drawing Sheets

SURFBOARD LOCK SYSTEM

BACKGROUND OF THE INVENTION

Surfboards are large and awkward to transport and store. They are also valuable and light enough to be easily carried away. Some of the surfing community devote little time to earning funds. Consequently, valuable surfboards are often left exposed and unattended where they are then easily stolen by surfers short of funds.

U.S. Pat. No. 5,127,861 issued Jul. 7, 1992 to Ross and 4,712,394 issued Dec. 15, 1987 to Ross teach a lockable cable that passes through the surfboard. A large hole is cut in the body of surfboard to accommodate a sleeve through which the cable passes in effect damaging the board and altering its properties.

U.S. Pat. No. 5,706,680 issued Jan. 13, 1998 to Wroble teaches a complex three piece surfboard locking assembly (FIGS. 5A,5B,5C) that adjustably engages the board with two hook members one from each side meeting a third member that encircles only the base of a central fin. One lock holds the assembly to the board and an attached cable may be locked about a secure object.

SUMMARY OF THE INVENTION

It is accordingly an object of the invention to provide a very simple and easy to use assembly to secure a surfboard to another item so that it not easily stolen. Surfboards are generally made with one or more fins that are removably attached by one or two fasteners to the underside of the board. They are readily detached for transport and replaced when damaged. They may also be replaced when different performance is needed. The surfboard may be tethered to any non-portable item such as a light pole, truck, or bicycle rack with a lockable cable passing through a small hole in the fin. The hole is not large enough to affect performance, but the fin is readily detached. This leaves the owner with a fin and the thief with the board, needing only a fin. It is an object of the invention to provide a system of securing a surfboard to another item by a lockable cable that passes through a small hole in the fin. It is another object that the system prevent a thief from removing the fin from the surfboard without seriously damaging the board itself.

The system of the invention comprises a not easily destroyed rigid sleeve that is adapted to slide over one fin. A flange at the base of the sleeve extends over the one or more fasteners that fasten the fin to the board. A hole in the sleeve and a hole in the fin are in registry when the flange rests on the board, thereby covering the fasteners. A lockable cable passes through the holes to secure the board to a non-portable item. The thief cannot detach the fin because the fin fasteners are rendered inaccessible by the flange. The cable passing through the fin and the sleeve must be removed by unlocking the cable lock before the surfboard can be moved. The cable is made to be cut resistant like the cables used to lock bicycles and the like.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
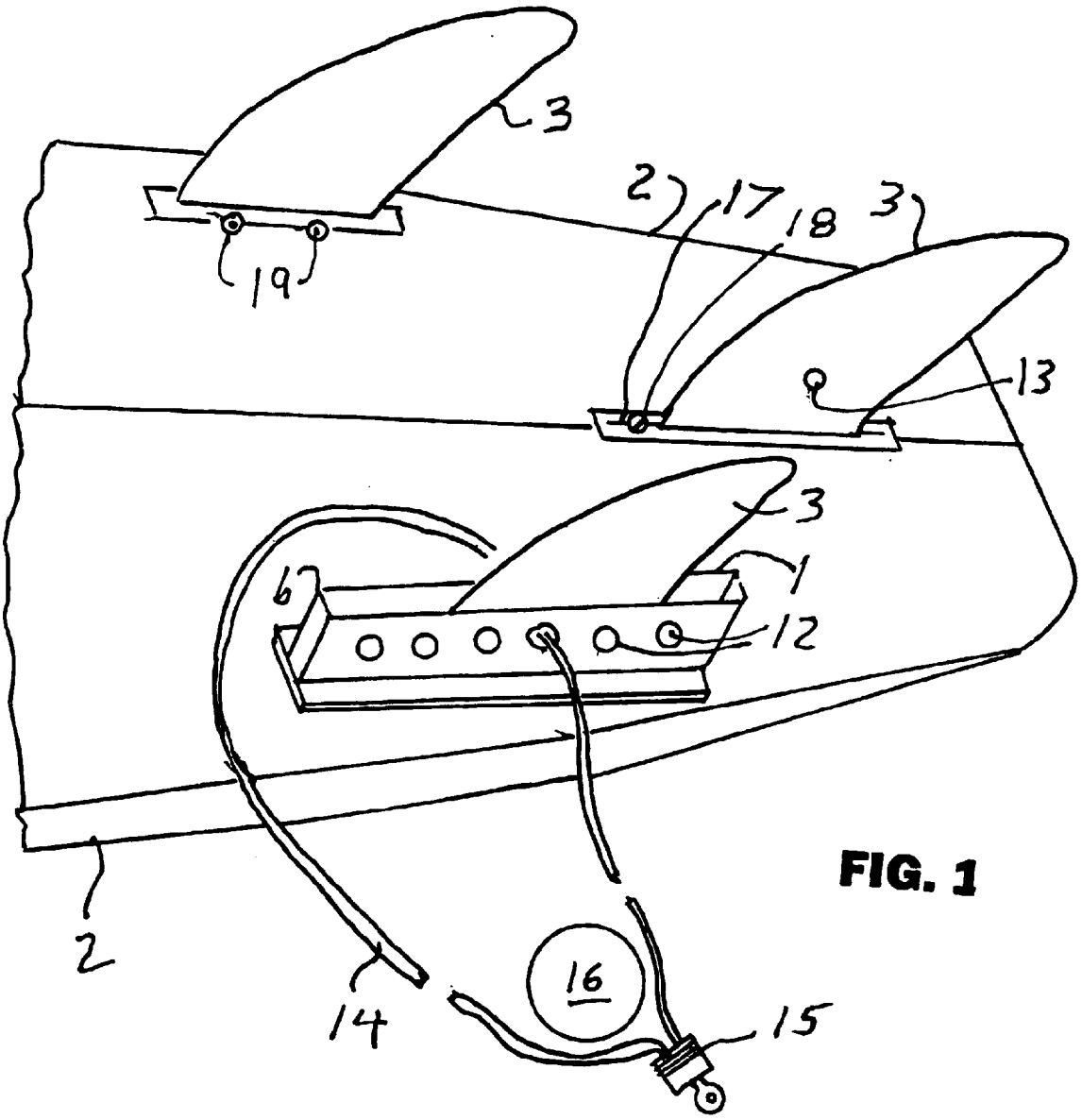
FIG. 1 is a perspective view of the securing system of the invention in place on a surfboard.
Figure 2:
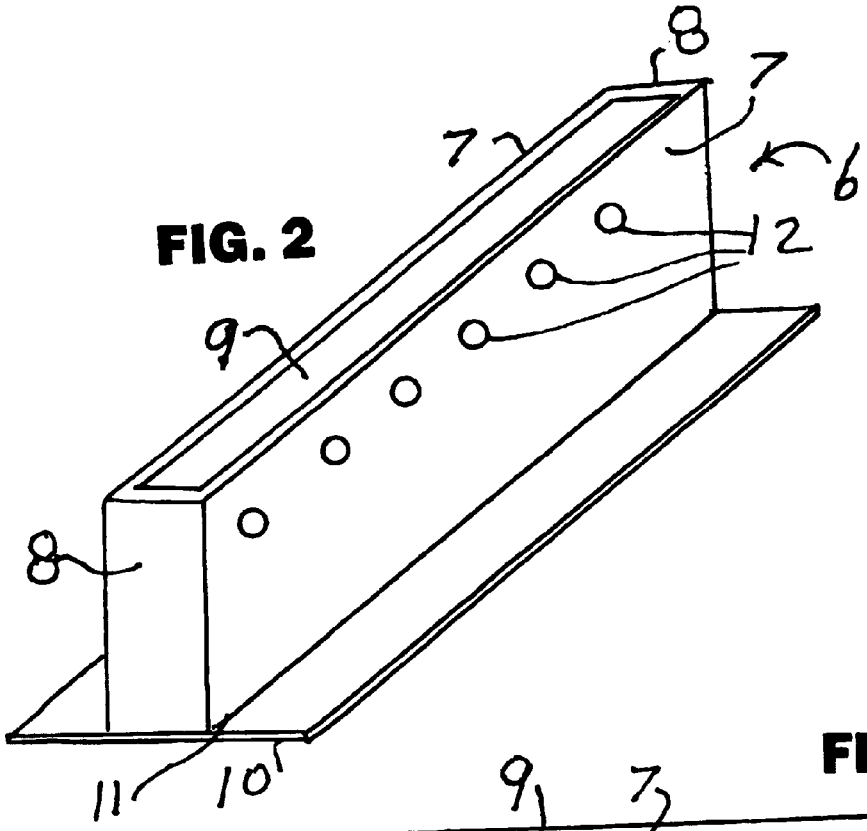
FIG. 2 is a perspective front view of the sleeve of the invention.
Figure 4:
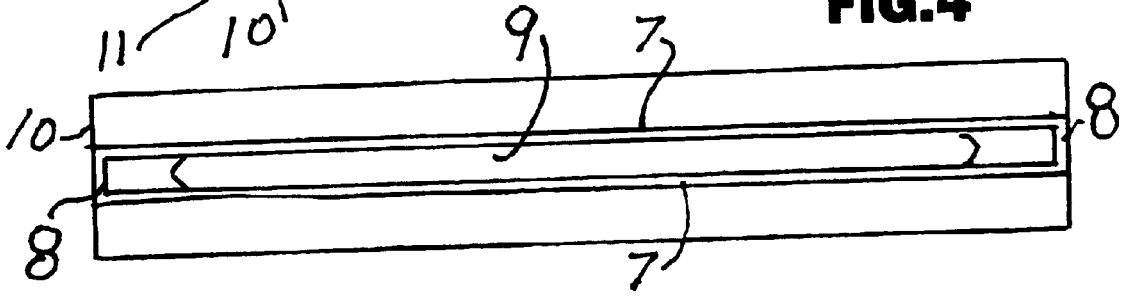
FIG. 4 is a top view of the sleeve.
Figure 3:
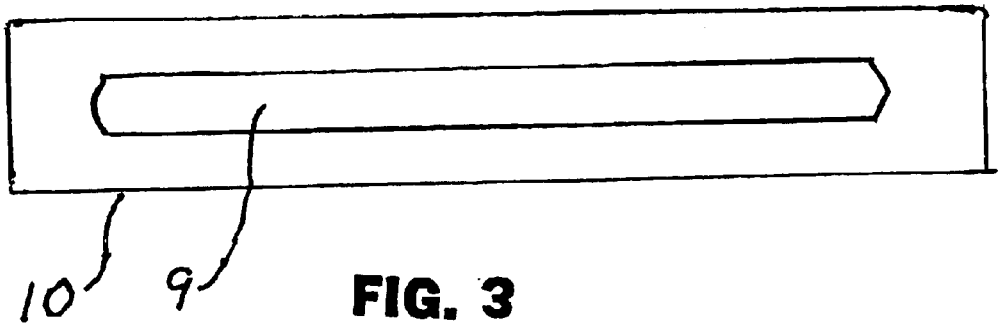
FIG. 3 is a bottom view of the sleeve.

Referring now to the drawing Figures, a lockable securing assembly 1 of the invention includes a sleeve 6 having a pair of broad opposed first sides 7, and a pair of narrow opposed sides 8. These define an internal space 9. A flange 10 is affixed to the base 11 of the sleeve. The top of the sleeve and the bottom of the sleeve and flange are open. The internal space 9 is dimensioned to receive a fin 3 of the surfboard 2, as best seen in FIG. 1. A transverse hole 13 is made in the fin. At least one, or a plurality, of through holes or passages 12 are provided in the broad sides 7, arranged so that hole 13 in the fin will be in registry with one of the passages 12 when the flange is against the surfboard 2. This enables a cut resistant cable 14 to pass through holes 12 and 13, thereby preventing lifting of the sleeve. The cable may then be passed around a non-portable item 16 and the ends locked by lock 15.

Fins 3 are anchored in the surfboard. The bottom of the fin fits in a slot 17 in the board 2. In the case of many central fins, the slot is longer than the fin, and the fin is held firmly in place at a selected longitudinal position in the slot by a single threaded fastener 18. In other cases the fin is secured by two transverse set screws 19. These must be removed with an Allen wrench. The flange 10 is broad enough so that it covers either type of fastener to prevent a thief from accessing the fastener(s) to remove the fin from the board, when the sleeve and cable are in position. The sleeve and flange may be made of metal or other durable material, as desired.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A lockable securing assembly for tethering a surfboard having a fin extending downward from a bottom surface to which it is attached by at least one fastener, the assembly comprising:

a) a rigid metal sleeve having broad opposed first sides and narrow opposed second sides defining an internal space dimensioned to receive the fin;

b) a flange affixed to the base of the sleeve, the flange dimensioned to cover said at least one fastener when the sleeve is positioned on the fin with the flange resting on the board;

c) at least one through passage passing through both broad opposed sides; and d) an elongate, lockable cable adapted for passing through the at least one passage and a hole in the fin in registry with the at least one passage.

2. A lockable securing assembly for tethering a surfboard having a fin extending downward from a bottom surface to which it is attached by at least one fastener, the assembly comprising:

a) a rigid sleeve having broad opposed first sides and narrow opposed second sides defining an internal space dimensioned to receive the fin;

b) a flange affixed to the base of the sleeve, the flange dimensioned to cover said at least one fastener when the sleeve is positioned on the fin with the flange resting on the board;

c) a plurality of through passages passing through both broad opposed sides; and d) an elongate, lockable cable adapted for passing through one of the passages and a hole in the fin in registry with one of the passages.

* * * * *